United States Patent [19]

Maes et al.

[11] Patent Number: 4,926,438

[45] Date of Patent: May 15, 1990

[54] LASER POINTER

[75] Inventors: Félix V. Maes, Barchon; Michel Baikrich, Tilff, both of Belgium

[73] Assignee: ARSOC S.p.r.l., Barchon, Belgium

[21] Appl. No.: 236,520

[22] PCT Filed: Nov. 18, 1987

[86] PCT No.: PCT/BE87/00016

§ 371 Date: Aug. 29, 1988

§ 102(e) Date: Aug. 29, 1988

[87] PCT Pub. No.: WO88/04024

PCT Pub. Date: Jun. 2, 1988

[51] Int. Cl.[5] ..... H01S 3/00

[52] U.S. Cl. ..... 372/109

[58] Field of Search ..... 372/65, 108, 107, 109; 33/241, 50; 434/22; 250/203 R

[56] References Cited

U.S. PATENT DOCUMENTS

| | | | |
|---|---|---|---|
| 2,715,275 | 8/1955 | Kipp | 33/50 |
| 3,867,764 | 2/1975 | Dunmire et al. | 33/241 |
| 4,161,652 | 7/1979 | Moreau et al. | 260/203 R |
| 4,830,381 | 5/1989 | Sellner | 434/22 |

*Primary Examiner*—Léon Scott, Jr.

*Attorney, Agent, or Firm*—Charles F. Meroni, Jr.

[57] ABSTRACT

Laser pointer comprising a laser cell (10) housed into a laser holder nose (1) mounted on a casing (2) which encloses a current source, a casing (2) being carried by a support (4) adapted to be mounted on a weapon, the support (4) carrying a lever (5) mounted to swivel about a pivot (6) secured to the support (4) and extended parallel to the axis of the laser holder nose (1), said lever (5) being arranged so that when it is in a pivoted position, it actuates a contactor (*7a*) which cooperates with a contact (*7b*) so that the cell is energized and produces a laser beam.

12 Claims, 2 Drawing Sheets

LASER POINTER

This invention relates to a laser pointer for a hand or shoulder weapon, of compact modular construction.

Known laser sights take the form of a casing intended to be mounted above the sight of the weapon, below or beside the gun, controlled by cable and microswitches. The laser beam is adjusted by means of two screws projecting from the casing. With this type of sight, the axis of the laser beam shows considerable parallax relative to the shooting axis and the handling of the weapon on which the sight is mounted requires the use of both hands, i.e. one hand for controlling the laser and the other hand for controlling the firing of the weapon.

The invention relates to a compact laser sight or pointer the mechanical design of which enables it to be mounted on a weapon in such a way that the parallax is considerably reduced.

It also relates to a laser pointer of modular construction which can be subjected to a large number of variations but with considerable standardisation and great flexibility of use.

This objective is achieved thanks to the invention with a laser pointer characterized in that the laser cell is accommodated in a laser holder mounted on a casing intended to receive a current source, this casing being carried by a support for mounting on a weapon, said support having a lever mounted so as to swivel about a pivot fixed on the support and extending parallel to the axis of the laser holder nose, said lever being designed so that, when it is in the pivoted position, it actuates a contactor which cooperates with a contact so that voltage is supplied to the cell.

The above-mentioned lever is preferably in a form having an arm which is laterally offset relative to the vertical axial plane of the casing. This arrangement has the advantage of allowing the laser and the trigger to be controlled simultaneously with one hand.

According to a second aspect of the invention, the direction of the axis of the laser beam is maintained and adjusted by means of rods arranged in two perpendicular directions and held between the outer surface of the laser cell and rings having an inner surface which is eccentric relative to the axis of the laser cell, rotation of each of these rings causing axial displacement of the rods which bear on the inner surface of the ring.

Figure 1:
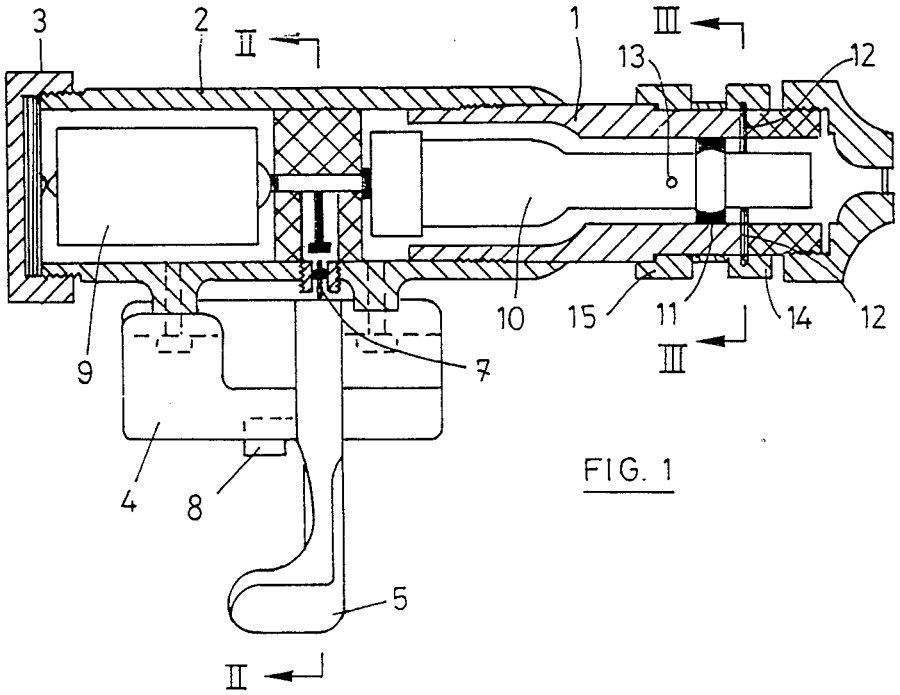
Figure 2:
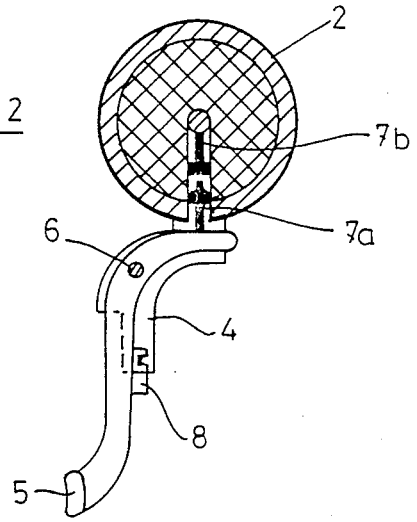
Figure 3:
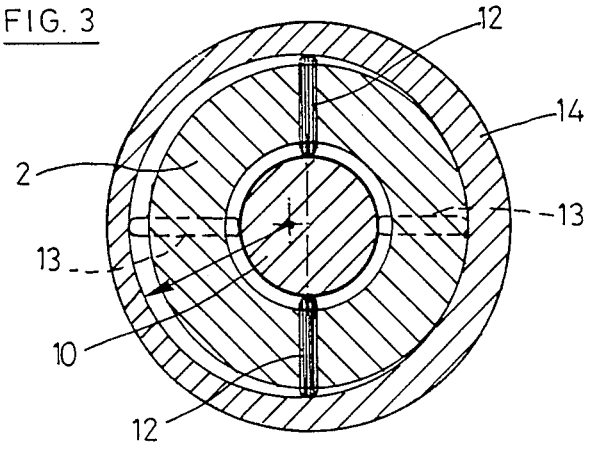
Figure 4:
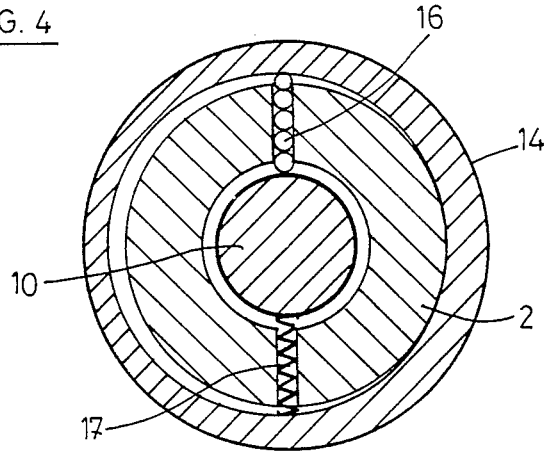

Other features of the invention will become apparent from the following description of an embodiment by way of example of the invention, with reference to the accompanying drawings, wherein:

FIG. 1 is an axial section through an embodiment of the laser pointer according to the invention, FIG. 2 is a cross-section on the line II—II of FIG. 1, FIG. 3 is a transverse section on the line III—III of FIG. 1, FIG. 4 shows an alternative embodiment equivalent to the assembly of FIG. 3.

Referring to FIG. 1, it will be seen that the laser pointer or laser sight according to the invention has a nosepiece 1 in which is accommodated the laser cell 10 containing the electronic and optical components known per se which are required to produce a laser beam. The nosepiece 1 is mounted on a casing 2 containing the battery or batteries which constitute the current source. The casing 2 is closed off by a cover 3 which can be opened in order to insert the current source.

Inside the nosepiece 1, the laser cell 10 is held in position by a swivel joint made of hardened steel 11. The direction of the axis L of the laser cell 10, i.e. the direction of the axis of the laser beam, is maintained by rods 12, 13 arranged in two perpendicular directions. The direction of the axis of the laser beam is regulated by axially moving the rods 12 and 13. According to the invention, these rods are held between the outer surface of the laser cell 10 and the inner surface of two rings 14 and 15. As shown particularly in FIG. 3, the inner surfaces of the rings 14 and 15 are eccentrically mounted relative to the axis L of the laser cell 10. When a ring is rotated, the rods on which the ring bears are axially displaced and consequently move the axis L of the laser beam.

The rods 12 and 13 may be replaced by ball bearings 16 or springs 17, for example. FIG. 4 diagrammatically shows both these alternative embodiments. Adjustment by means of eccentric rings has the advantage of eliminating the projecting adjusting screws and reducing the bulk of the nosepiece while ensuring a perfect seal.

The casing 2 is carried by a support 4 enabling the device to be mounted on a weapon. On the support 4 is mounted a lever 5 capable of pivoting about a pivot axis 6 extending parallel to the axis of the sight and shown in FIG. 2. The lever 5 is arranged so that, when it is in the pivoted position, it actuates a contactor *7a* which cooperates with the contact *7b* to ensure that voltage is supplied to the laser cell 10 in order to produce a laser beam. A bolt 8 can be used to block the lever 5 to prevent the laser from being actuated accidentally. The support 4 may be integral with the casing 2.

As shown more particularly in FIG. 2, the lever 5 has a curved shape with an arm which is laterally offset relative to the axial vertical plane of the casing 2. As a result of this arrangement, the laser sight according to the invention can be mounted on a weapon in an angular position at 45° to the vertical axial plane of the sighting mechanism on the weapon, thus bringing the axis of the laser beam close to the firing axis and thereby reducing the parallax Moreover, the laser sight leaves the sighting device free.

Then again, the control lever 5 may be situated on the side of the barrel of the weapon and may be actuated with one hand at the same time as the weapon is discharged. The lever 5 may be placed either on the right or the left of the barrel, as desired.

A significant practical advantage is that the control of the laser and the discharge of the weapon may be effected simultaneously and with one hand. Finally, the control lever constitutes an effective and reliable method of actuating the contactor and starting up the laser.

The modular design of the laser sight according to the invention can be subjected to a large number of variations. The shape of the casing 2 can be adapted to the batteries used and the support may be adapted to the types of weapons while considerable standardisation of manufacture is maintained and great flexibility of assembly is ensured depending on the type of weapon or the particular requirements of the user.

We claim:

1. A laser pointer comprising:

a casing with a nosepiece having a longitudinal axis, a laser generator for producing a laser beam, said laser generator being contained in the nosepiece, a voltage source contained in the casing, said voltage source being connected to the laser generator, an outer ring mounted about the nosepiece so as to provide rotation about the longitudinal axis of the nose piece, laser generator positioning means connecting an outer surface of the laser generator and an inner surface of said ring such that rotation of said outer ring about the longitudinal axis of the nose piece causes axial displacement of the laser generator and the laser beam.

2. A device according to claim 1, wherein the positioning means are rods are arranged in two perpendicular directions.

3. A device according to claim 1, wherein the positioning means are ball bearings.

4. A device according to claim 1, wherein the positioning means are springs.

5. A device according to claim 1, wherein the positioning means are balls or bearings.

6. A device according to claim 1, wherein the positioning means are partially rods and partially springs.

7. A device according to claim 1, wherein the positioning means are partially ball bearings and partially springs.

8. A device according to claim 1, wherein the outer ring is provided with an eccentric way for actuating said positioning means.

9. A device according to claim 1, wherein the laser generator has a swivel joint holding said laser generator inside the holder means.

10. A device according to claim 1, wherein the casing is provided with an attachment means for adaptation to a support.

11. A device according to claim 1 wherein:

casing is provided with a support for mounting the device on a weapon, said casing including contactor means for supplying the voltage from said voltage source to the laser generator when it is actuated, said support having a lever mounted thereon so as to pivot around a pivot fixed to the support, said lever extending parallel to the longitudinal axis of the nosepiece, said lever having an end adapted to actuate said contactor means when it is in a pivoted position.

12. A device according to claim 11, wherein the lever has a curved shape with an arm which is laterally offset relative to the vertical axial plane of the casing.

* * * * *